US010400501B1

(12) United States Patent
Tatley et al.

(10) Patent No.: US 10,400,501 B1
(45) Date of Patent: Sep. 3, 2019

(54) WINDOW ASSEMBLY AND PRE-FABRICATED WALL PANEL

(71) Applicant: Build Smart IP, LLC, Lawrence, KS (US)

(72) Inventors: Ronald D. Tatley, Santa Rosa Beach, FL (US); John Grahovac, Kansas City, KS (US); Perry Quick, Olathe, KS (US)

(73) Assignee: Build Smart IP, LLC, Lawrence, KS (US)

( * ) Notice: Subject to any disclaimer, the term of this patent is extended or adjusted under 35 U.S.C. 154(b) by 0 days.

(21) Appl. No.: 15/596,694

(22) Filed: May 16, 2017

Related U.S. Application Data

(60) Provisional application No. 62/336,847, filed on May 16, 2016.

(51) Int. Cl.

| | |
|---|---|
| ***E06B 1/36*** | (2006.01) |
| ***E04B 1/76*** | (2006.01) |
| ***E06B 7/23*** | (2006.01) |
| ***E06B 3/263*** | (2006.01) |
| ***E06B 3/06*** | (2006.01) |
| ***E06B 1/70*** | (2006.01) |
| ***E06B 3/267*** | (2006.01) |

(52) U.S. Cl.
CPC ..... *E06B 1/36* (2013.01); *E04B 1/7641* (2013.01); *E06B 1/702* (2013.01); *E06B 3/06* (2013.01); *E06B 3/263* (2013.01); *E06B 3/267* (2013.01); *E06B 7/23* (2013.01)

(58) Field of Classification Search
CPC ..... E04B 1/7641; E06B 1/36; E06B 1/702; E06B 3/06; E06B 3/263; E06B 3/267; E06B 7/23
See application file for complete search history.

(56) References Cited

U.S. PATENT DOCUMENTS 2,612,097 A * 9/1952 Pollman ..... E06B 7/02 454/224
2,733,787 A * 2/1956 Morra ..... E06B 1/12 49/504

(Continued)

OTHER PUBLICATIONS

Prosoco FastFlash Product Literature (Year: 2011).*

*Primary Examiner* — James M Ference
(74) *Attorney, Agent, or Firm* — Erickson Kernell IP, LLP; Kent R. Erickson

(57) ABSTRACT

A window installation and a wall panel and methods for construction thereof. The window installation includes a window liner in which a window unit can be installed. The window liner includes jambs, a header, and a sill that circumscribe the window unit and an exterior flange that depends outwardly from external edges thereof. The wall panel is a prefabricated panel that includes framing with sheathing and insulating members disposed on an exterior surface thereof and forms an opening in which the window liner is received. An external sheathing of the wall panel is formed with a larger opening dimensioned to receive the exterior flange of the window liner. The window liner and window unit can be removed from the wall panel to ease movement and transport of the wall panel and to reduce risks of breaking the window unit during manufacture and transport.

18 Claims, 9 Drawing Sheets

(56) References Cited

U.S. PATENT DOCUMENTS 4,219,971 A * 9/1980 Mauroner ..... E05D 15/08 49/372
4,624,085 A * 11/1986 Thosath ..... E06B 3/302 52/211
4,756,135 A * 7/1988 Citrullo ..... E06B 1/02 52/211
4,793,114 A * 12/1988 Pacca ..... E06B 1/702 52/204.5
5,544,457 A * 8/1996 Labrecque ..... E06B 3/5835 52/204.69
6,253,514 B1 * 7/2001 Jobe ..... E04B 1/6801 52/395
6,634,146 B2 * 10/2003 Carlson ..... E06B 1/6046 52/202
6,920,726 B2 * 7/2005 Bielefeld ..... E06B 3/221 49/504
7,165,364 B2 * 1/2007 Inelli ..... E06B 1/02 52/204.1
7,987,633 B2 * 8/2011 Lenox ..... E06B 3/26303 49/504
8,109,052 B2 * 2/2012 Rosende ..... E06B 1/6015 52/204.53
8,302,364 B2 11/2012 Hohmann, Jr.
8,484,902 B1 * 7/2013 Brown ..... E06B 3/308 49/401
8,607,514 B2 * 12/2013 Peterson ..... E06B 1/26 52/211
8,613,181 B2 * 12/2013 Jay ..... E06B 1/62 52/410
9,074,406 B2 * 7/2015 Vos ..... E06B 1/62
2001/0034984 A1 * 11/2001 Murphy ..... E06B 1/62 52/204.5
2003/0056444 A1 * 3/2003 Ackerman, Jr. ..... E06B 1/62 52/58
2003/0226320 A1 * 12/2003 Engebretson ..... E06B 1/345 52/204.5
2003/0226321 A1 * 12/2003 Engebretson ..... E06B 1/345 52/204.54
2004/0226232 A1 * 11/2004 Engebretson ..... E06B 1/345 52/204.1
2005/0050815 A1 * 3/2005 Engebretson ..... E06B 1/345 52/204.52
2005/0144856 A1 * 7/2005 Conlin ..... E04D 13/1475 52/58
2005/0178079 A1 * 8/2005 Hardman ..... E06B 1/02 52/208
2006/0010822 A1 * 1/2006 Moffatt ..... E06B 1/6015 52/712
2006/0143996 A1 * 7/2006 Alvarado ..... E06B 1/02 52/204.53
2006/0156654 A1 * 7/2006 Weiss ..... E06B 1/702 52/204.5
2006/0236618 A1 * 10/2006 Williams ..... E06B 1/62 52/58
2008/0184637 A1 * 8/2008 Miller ..... E04F 19/02 52/211
2008/0295450 A1 * 12/2008 Yogev ..... E04C 2/26 52/783.1
2009/0145067 A1 * 6/2009 Tatley ..... E06B 1/62 52/411
2009/0193728 A1 * 8/2009 Butler ..... E06B 1/34 52/213
2010/0170186 A1 * 7/2010 Hohmann, Jr. ..... B32B 5/18 52/741.4
2011/0005153 A1 * 1/2011 Schield ..... E06B 1/68 52/204.53
2012/0055107 A1 3/2012 Butler et al.
2013/0276405 A1 10/2013 Tatley et al.
2014/0041326 A1 * 2/2014 Kadavy ..... E06B 7/16 52/209
2014/0196396 A1 * 7/2014 Watts ..... C09D 7/61 52/408
2014/0331576 A1 * 11/2014 Brown ..... E06B 3/26341 52/204.5
2015/0047269 A1 * 2/2015 Messenger ..... E06B 7/14 52/58
2015/0218808 A1 * 8/2015 Bates ..... E04C 2/205 52/274

* cited by examiner

WINDOW ASSEMBLY AND PRE-FABRICATED WALL PANEL

CROSS-REFERENCE TO RELATED APPLICATIONS

This application claims the benefit of U.S. Provisional Patent Application No. 62/336,847, filed May 16, 2016, the disclosure of which is hereby incorporated herein in its entirety by reference.

BACKGROUND

Building structures using components that are pre-fabricated offsite has become a common trend. Such structures can include manufactured homes which are nearly completely constructed in a warehouse, transported to an installation site in one or more pieces, and then joined together on-site. Other structures are constructed from a plurality of wall panels that are constructed offsite and then assembled and finished at the jobsite. With any of the available methods, the pre-fabricated components must be transported to the jobsite and oftentimes must be moved around the construction facility from one station to another or onto a transport vehicle. These pre-fabricated components can become very heavy and difficult to move and manage and can be subject to damage during such movements.

Windows installed in the pre-fabricated components increase the weight thereof and are susceptible to breakage. A window installation that is removable during transport and/or installation of the pre-fabricated components would be advantageous for both transportation of the components and reducing the likelihood of breakage of the window. A window installation that is easier to ensure a proper seal and fit is achieved between the window and the wall opening and that minimizes thermal conductivity across the thickness of the wall into which the window is installed would also be beneficial.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a window installation and a wall panel and methods for construction thereof.

The window installation includes a window liner into which a window is installed. The window liner can be pre-fabricated and the window installed therein, or the window liner can be constructed around the window. Installation of the window into the liner can be completed on a workbench and in a horizontal orientation such that the installer need not work against gravity. The liner is coated with a water barrier and/or is constructed from water-resistant or water-proof materials that may also have low thermal conductivity. The liner includes a generally rectangular casing within which the window is installed. A flange extends outwardly about the perimeter of the casing and from an exterior edge thereof.

A wall panel may be provided that includes framing with an inner sheathing disposed on an exterior surface of the framing. An insulating member is disposed on an exterior surface of the inner sheathing and an exterior sheathing is disposed on an exterior surface of the insulating member. The framing, inner sheathing, and insulating member are cut or formed to provide an aperture into which the casing of the window liner can be inserted. The exterior sheathing is cut or formed to provide an opening into which the flange of the window liner can be received.

The window liner with the window installed therein is removable from the wall panel for transport or movement of the wall panel to reduce the weight of the panel and to reduce the risk of breaking the window during movement or construction activities. Upon final, permanent installation of the window liner into the wall panel, the window liner provides a barrier to entry of water and/or air into the wall panel or the interior of the structure and may provide a barrier to conduction of thermal energy through the wall panel.

DESCRIPTION OF THE DRAWINGS

Illustrative embodiments are described in detail below with reference to the attached drawing figures, and wherein.

DETAILED DESCRIPTION

Figure 1:
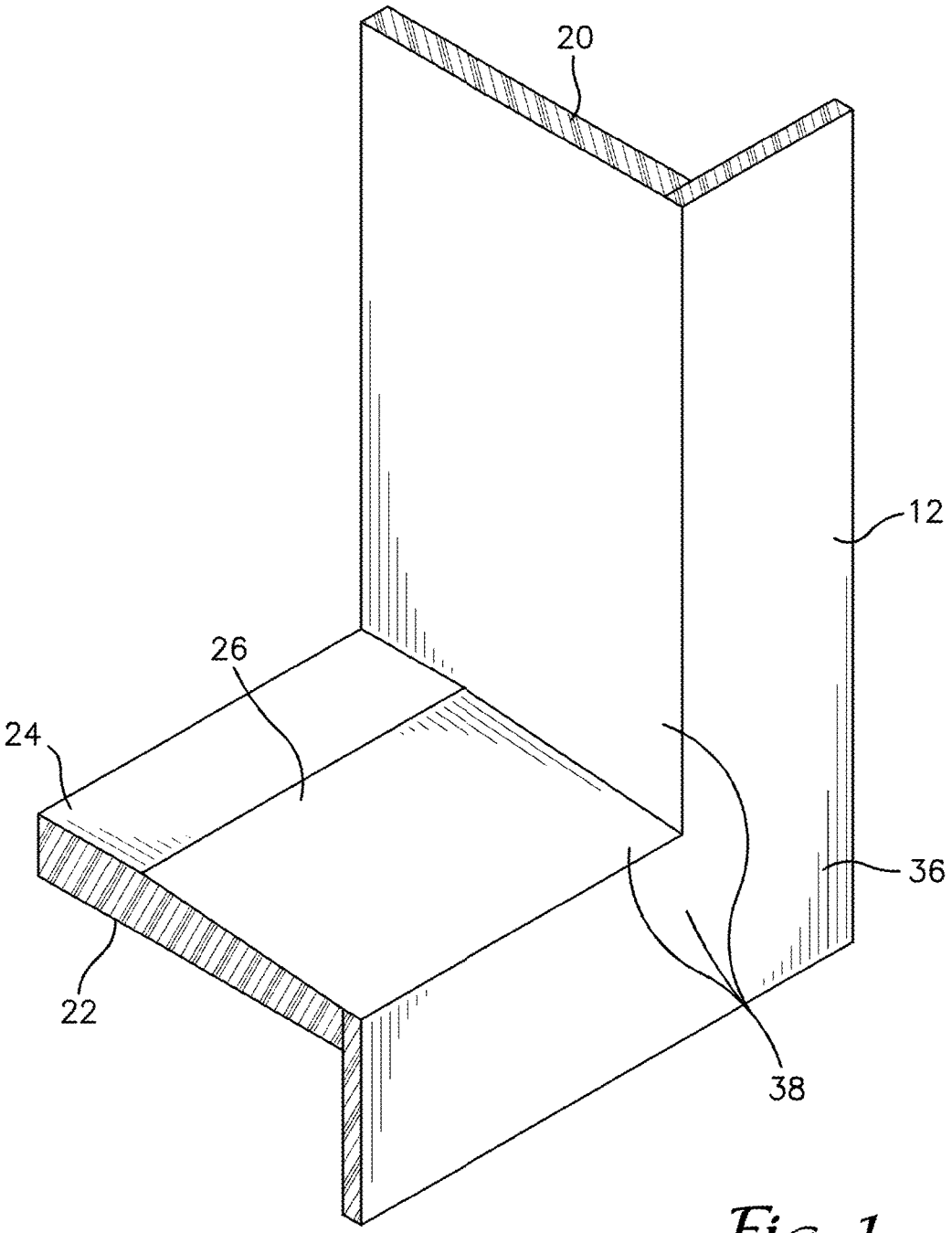
FIG. 1 is a partial perspective view of a window liner depicted in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

Exemplary embodiments are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

With reference to FIGS. 1-7, a window installation 10 is described in accordance with an exemplary embodiment. The window installation 10 includes a window liner 12, a window unit 14, and a wall panel 16. The window installation 10 is described herein with respect to pre-fabrication of components in a warehouse or construction facility, such as a pre-fabricated wall panel 16, and benefits that might be observed in such an application. However exemplary embodiment are not so limited. For example, the wall panel 16 can also comprise a wall assembly, a "stick-built" wall panel or assembly or similar structure constructed on site.

In one embodiment, the window liner 12 and the wall panel 16 are configured to surpass standards and requirements for air infiltration into/out of a building structure or building envelope, such as the PHIUS+ 2015 Passive Building Standard promulgated by the Passive House Institute US of Chicago, Ill. For example, the window liner 12 and the wall panel 16 may be configured to meet or exceed industry standards referred to as 0.05 cfm 50 and 0.08 cfm 75. In other words, under the 0.05 cfm 50 standard, the window liner 12 and the wall panel 16 may resist greater than 0.05 cubic feet per minute per square foot of surface area of air flow through the window liner 12 and wall panel 16 when a pressure difference between the interior and exterior of the building structure is fifty pascals, or under the 0.08 cfm 75 standard the window liner 12 and the wall panel 16 may resist greater than 0.08 cubic feet per minute per square foot of surface area of air flow through the window liner 12 and wall panel 16 when a pressure difference between the interior and exterior of the building structure is seventy-five pascals.

The window liner 12 or buck is configured to receive the window unit 14 therein or to be constructed around the window unit 14. The window liner 12 is shown and described herein with respect to a rectangular window unit 14, but may be configured for use with window units 14 of other shapes or arrangements including, single and multiple window units 14, arched or rounded window units, or the like. Only a portion of a frame 18 and pane 19 of the window unit 14 is shown in FIGS. 1-7 for sake of simplicity, but one of skill in the art will recognize that the window unit 14 also includes opening mechanisms and aesthetic treatments among a variety of other components. The window unit 14 can comprise any available type of window unit 14 including for example, fixed, casement, single- and double-hung, sliding, and pivoting, among others.

The window liner 12 includes a pair of side jambs 20 (only one shown), a header (not shown) extending between top ends of the jambs 20, and a sill 22 extending between bottom ends of the jambs 20. The side jambs 20 and the header are generally planar elements, and the sill 22 includes a top surface that is divided into a mounting portion 24 and a sloped portion 26. The mounting portion 24 is generally planar and horizontally aligned to provide a mounting location for the window frame 18. The sloped portion 26 is generally planar and slopes downwardly toward the exterior of the window liner 12 and/or the wall panel 16 into which the liner 12 is to be installed. In one embodiment, the sill 22 does not include the sloped portion 26 and thus has a generally planar, horizontally aligned surface. In another embodiment, the sill 22 does not include the mounting portion 24 and thus has a generally planer, sloped surface.

The side jambs 20, the header, and the sill 22 are dimensioned to receive the window unit 14 within a perimeter formed thereby with a small gap 28 therebetween. The gap 28 is sized to provide sufficient space between the window unit 14 and the window liner 12 for insertion of a sealing element 30. In one embodiment, the gap 28 is preferably at least about 0.25 inches (6 mm).

Figure 7:
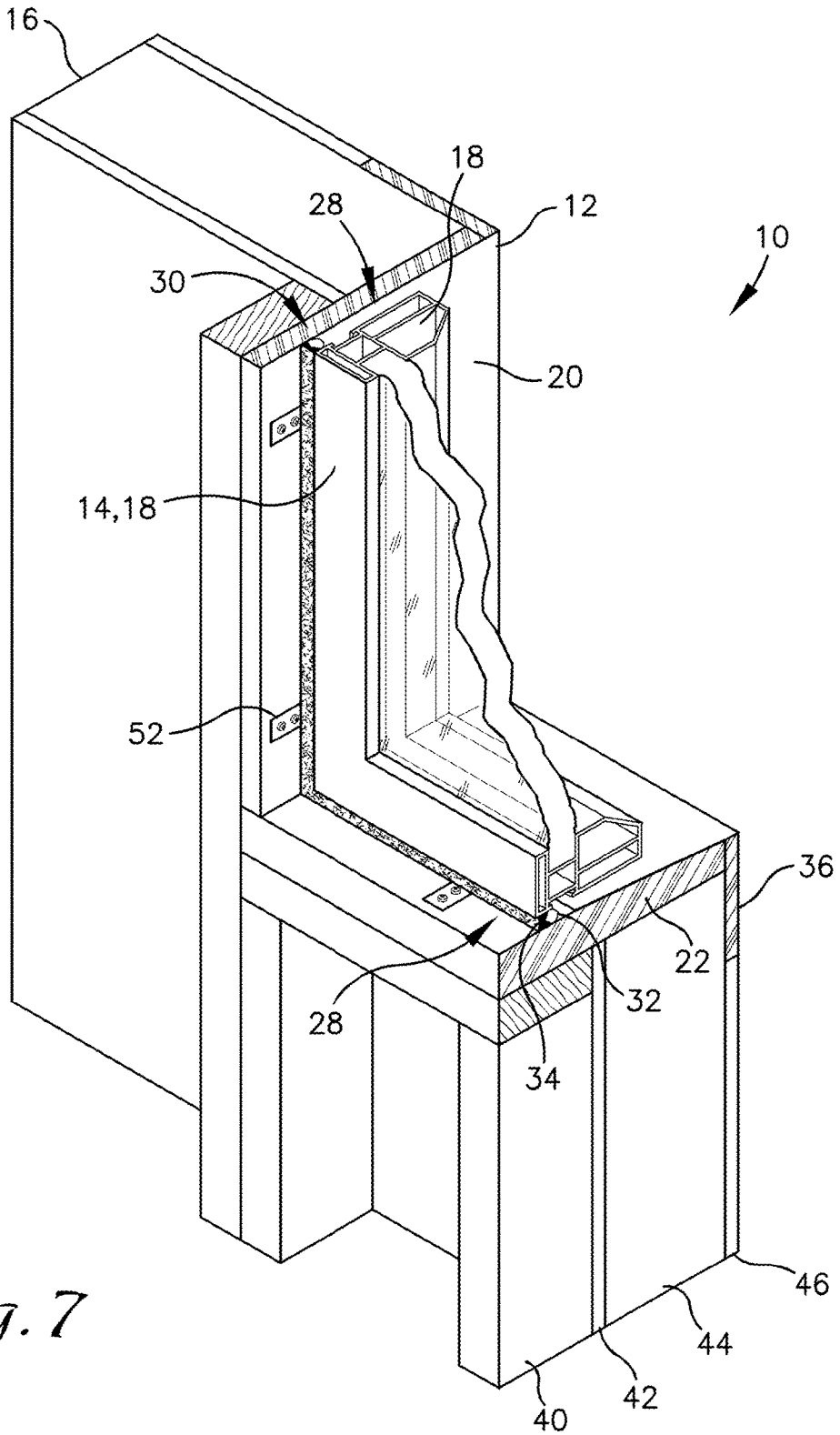
FIG. 7 is an interior partial perspective view of the wall panel and window liner of FIG. 5.

As depicted in FIG. 7, the sealing element 30 preferably comprises a closed cell foam backer rod 32 that is at least partially compressed between the window frame 18 and the window liner 12 and a sealant 34, such as a caulk or similar material that is disposed into the gap 28 on the interior side of the backer rod 32. The sealant 34 is preferably tooled after deposition in the gap 28 to provide a concave surface thereto which may aid to resist pealing or tearing of the sealant 34 away from the window frame 18 and/or the window liner 12 due to thermal expansion/contraction of the frame 18 and/or window liner 12. In one embodiment, the sealant 34 comprises AIRDAM from Prosoco of Lawrence, Kans.

The window liner 12 also includes an exterior flange 36 that extends outwardly from exterior edges of the jambs 20, header, and sill 22 and in substantially the same plane as an exterior surface of the wall panel 16. The exterior flange 36 is configured to at least partially overlap a portion of the wall panel 16 into which the window liner 12 is installed. The flange 36 may extend outwardly away from the jambs 20, header, and sill 22 a distance sufficient to be overlapped by an overlayment that is disposed on the exterior of the wall panel 16 such as siding, brick, stone, or similar finishing treatment.

An exposed surface 38 of the window liner 12 is coated with a water-proof coating to protect the liner 12 against environmental conditions. In one embodiment, the coating comprises FASTFLASH from Prosoco, of Lawrence, Kans. The window liner 12 may be constructed from weather-resistant materials or composites which may or may not benefit from the addition of a water-proof coating. In one embodiment, the window liner 12 includes one or more components formed from ZIP SYSTEM sheathing from Huber Engineered Woods of Charlotte, N.C., among other materials. In another embodiment, the window liner 12 or at least the jambs 20, the header, and the sill 22 are constructed from a material having low thermal conductivity that resists transfer of thermal energy between exterior and interior portions of the window liner 12.

Figure 4:
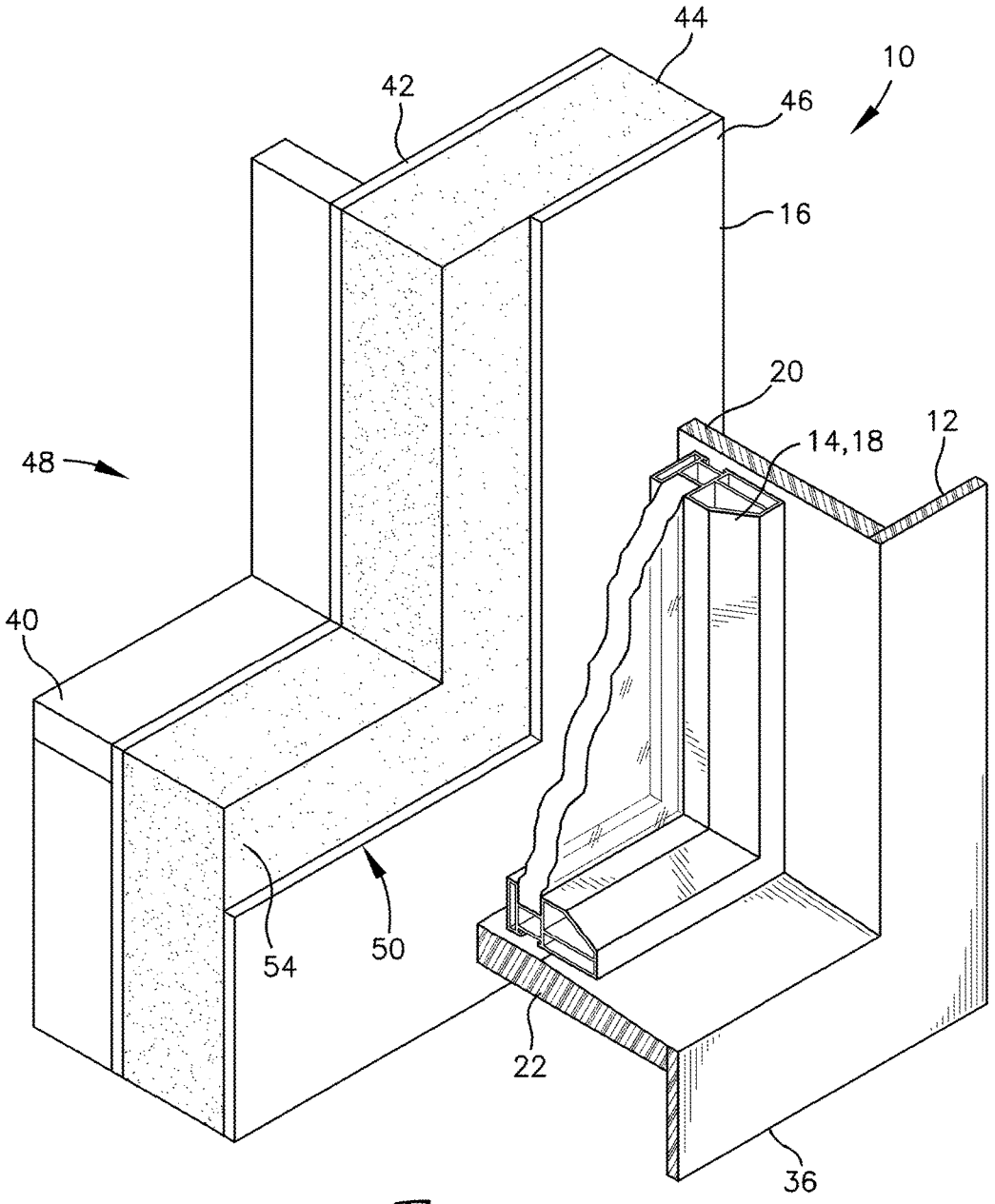
FIG. 4 is a partial perspective view of a wall panel and the window liner and window of FIG. 2 depicted in accordance with an exemplary embodiment.
Figure 5:
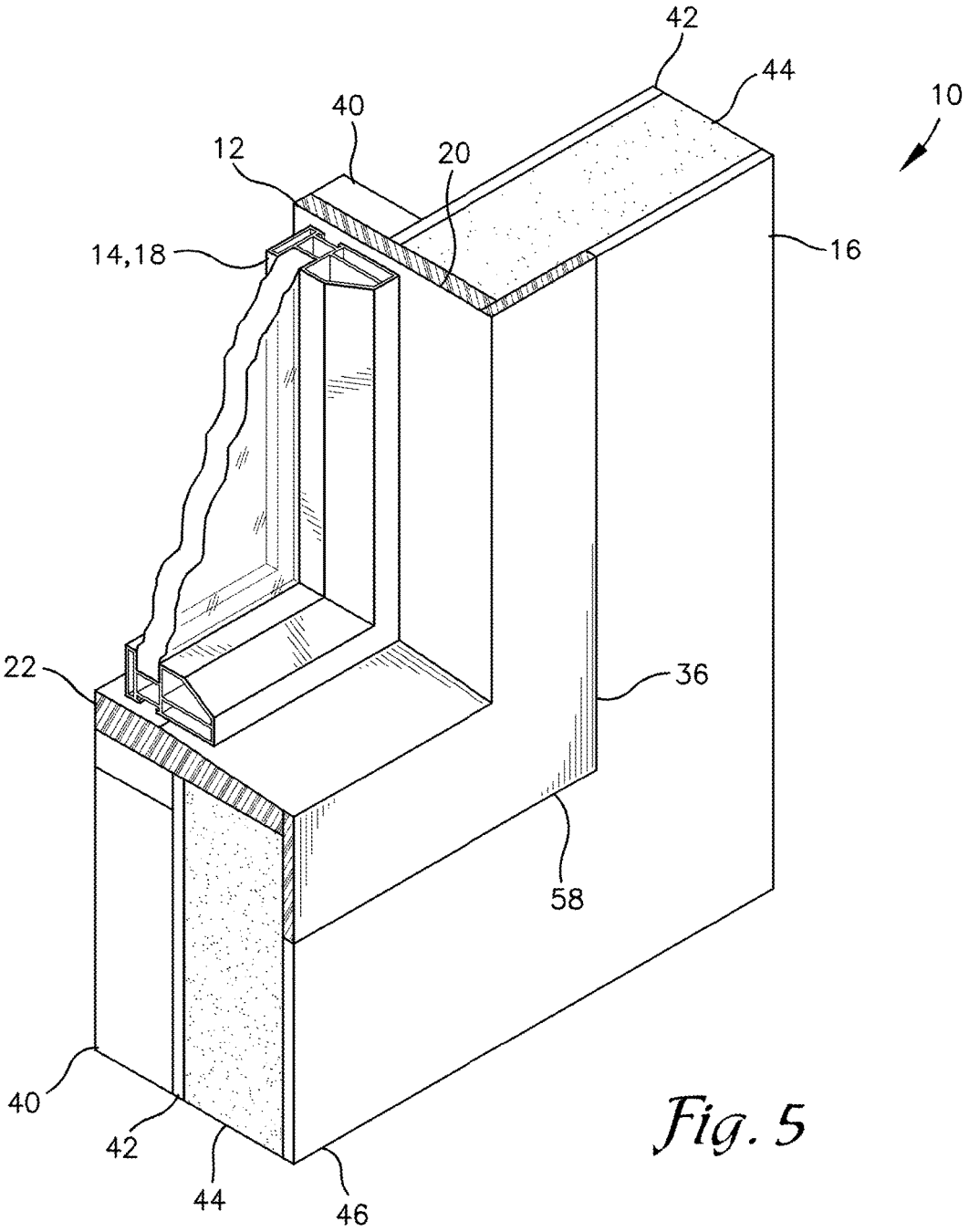
FIG. 5 is a partial perspective view of the wall panel and window liner of FIG. 4 with the window liner in an installed state.
Figure 6:
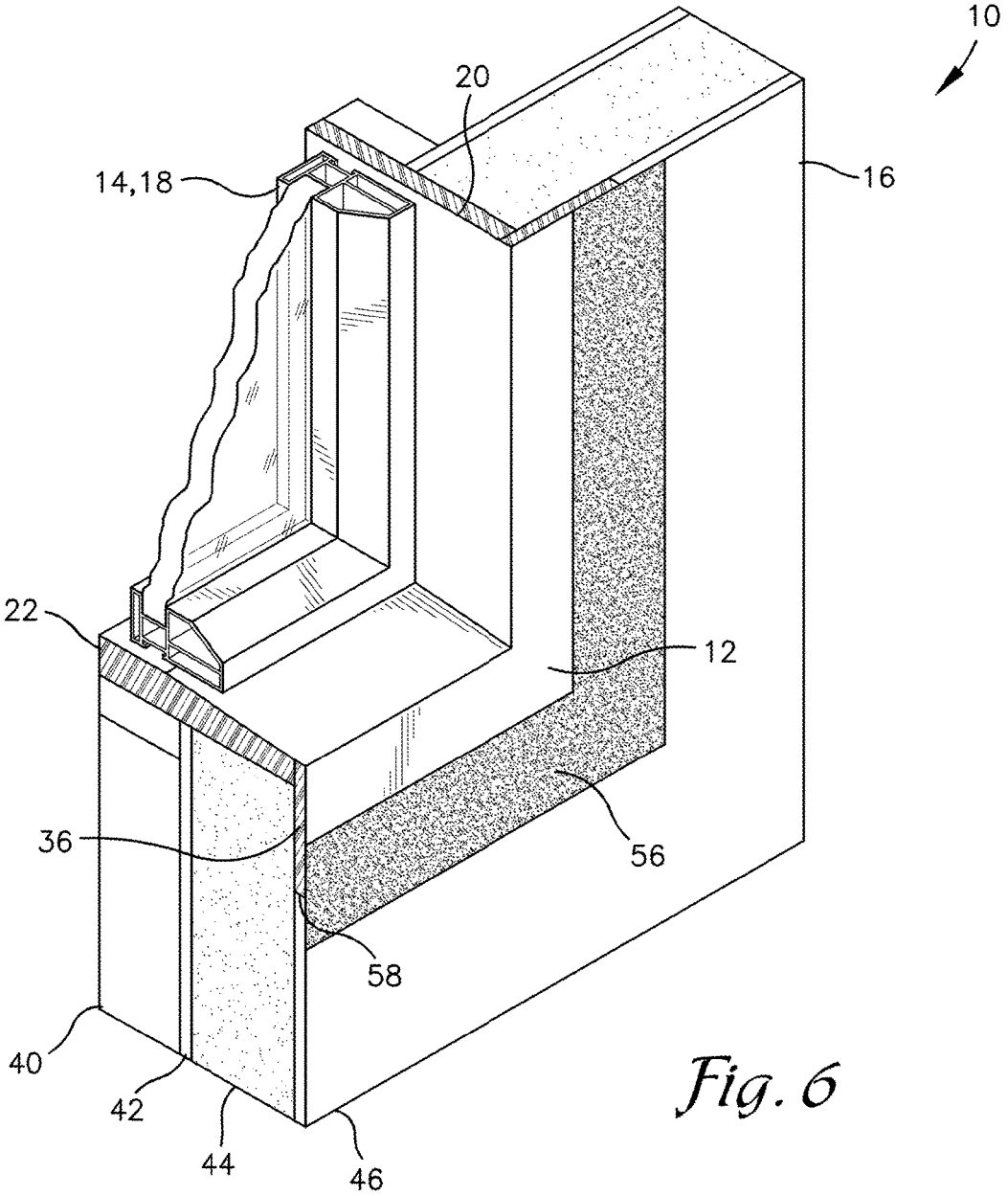
FIG. 6 is a partial perspective view of the wall panel and window liner of FIG. 5 with a sealing member disposed over a seam between the window liner and the wall panel.

As depicted in FIG. 4, the wall panel 16 comprises framing 40, an internal sheathing 42, an insulating layer 44, and an external sheathing 46 arranged in order from an interior to an exterior side of the wall panel 16. The framing 40 comprises available framing materials and technologies including, for example, wood or metal stud framing. The internal sheathing 42 comprises an available sheathing material, such as plywood, oriented strand board (OSB), or the like and is coupled to the exterior side of the framing by available methods, e.g. nails, fasteners, and/or glues or adhesives.

The insulating layer 44 comprises a generally rigid foam board or panel such as an extruded, closed-cell, polystyrene foam. The insulating layer 44 is disposed on an exterior surface of the internal sheathing 42 and may be coupled thereto using one or more of fasteners, adhesives, or the like. The composition and thickness of the insulating layer 44 can be selected to provide a desired insulating efficiency or R-value for the wall panel 16. For example the insulating layer 44 may be between 3.5 and 11.5 inches in thickness in some applications.

The external sheathing 46 comprises an available sheathing material, such as plywood, OSB, ZIP SYSTEM sheathing or similar material. The external sheathing 46 is preferably treated or configured to resist damage or deterioration from exposure to environmental factors like water, sunlight, insects, pests, or the like. For example, the external sheathing 46 may comprise OSB panels treated with a water-resistant coating. The external sheathing 46 is disposed on an exterior surface of the insulating layer 44 and may be coupled thereto via one or more of fasteners, adhesives, or the like.

The framing 40 is constructed to outline a fenestration or an opening 48 in which the window liner 12 is installable. The opening 48 is dimensioned to receive the window liner 12 in a generally tight-fitting manner. The opening 48 may be dimensioned just larger than the window liner 12 to provide space therebetween to enable shimming or adjustment of the window liner 12 relative to the opening. The internal sheathing 42 and the insulating layer 44 are formed or cut to continue the opening 48 therethrough, e.g. the opening is formed by and extends through the framing 40, the internal sheathing 42, and the insulating layer 44.

The exterior sheathing 46 is cut or formed to provide a second opening or recess 50 that is aligned with the opening 48 but that is dimensioned to receive the exterior flange 36 of the window liner 12. The second opening 50 has dimensions just larger than the outer dimensions of the exterior flange 36.

Although a particular configuration of the wall panel 16 is described and shown herein, it is understood that the wall panel 16 can take other forms and configurations without departing from the scope of exemplary embodiments described herein. For example, the wall panel 16 might comprise a wall built on-site that includes insulation disposed within the framing, among other configurations.

Figure 2:
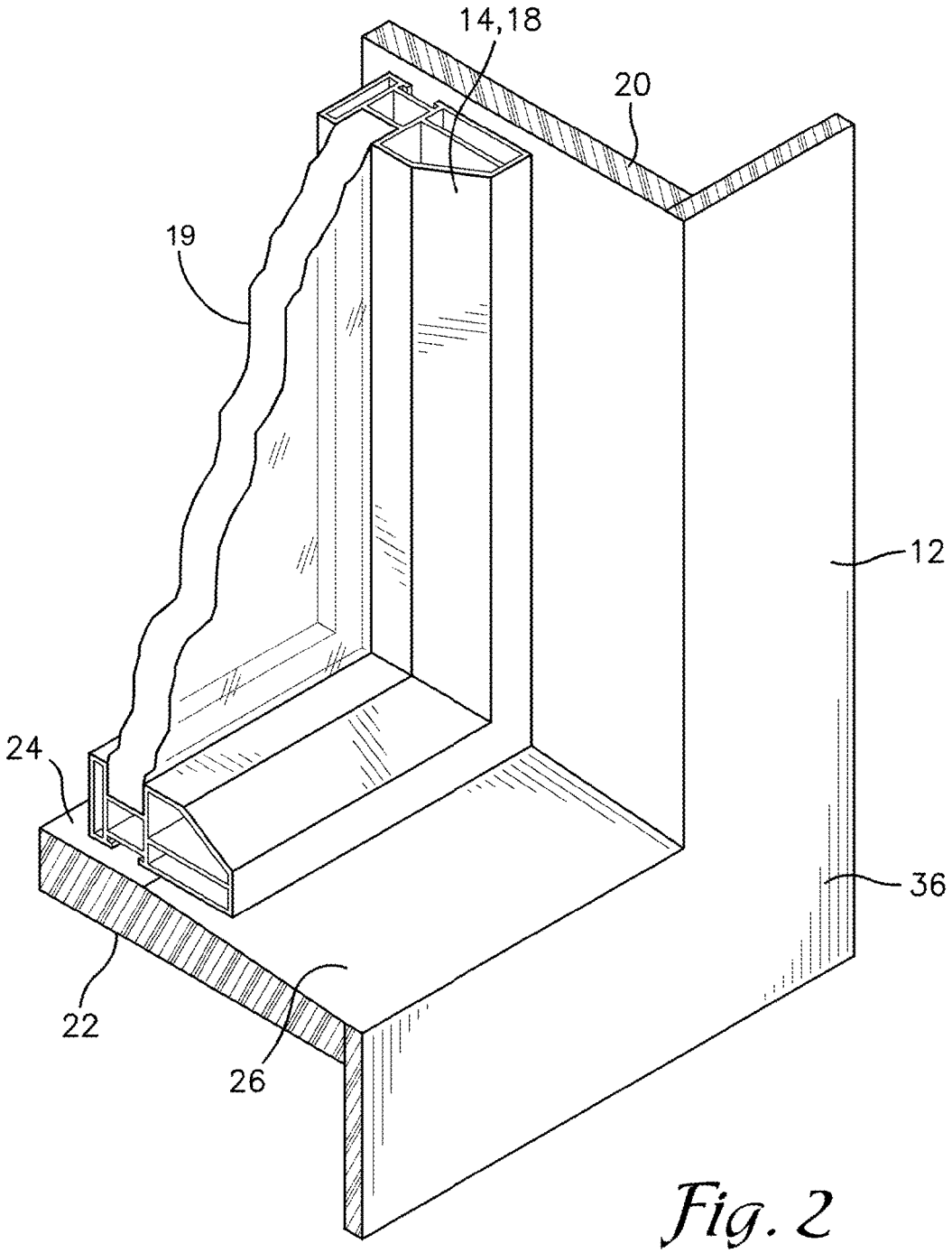
FIG. 2 is a partial perspective view of the window liner of FIG. 1 with a window installed therein.
Figure 3:
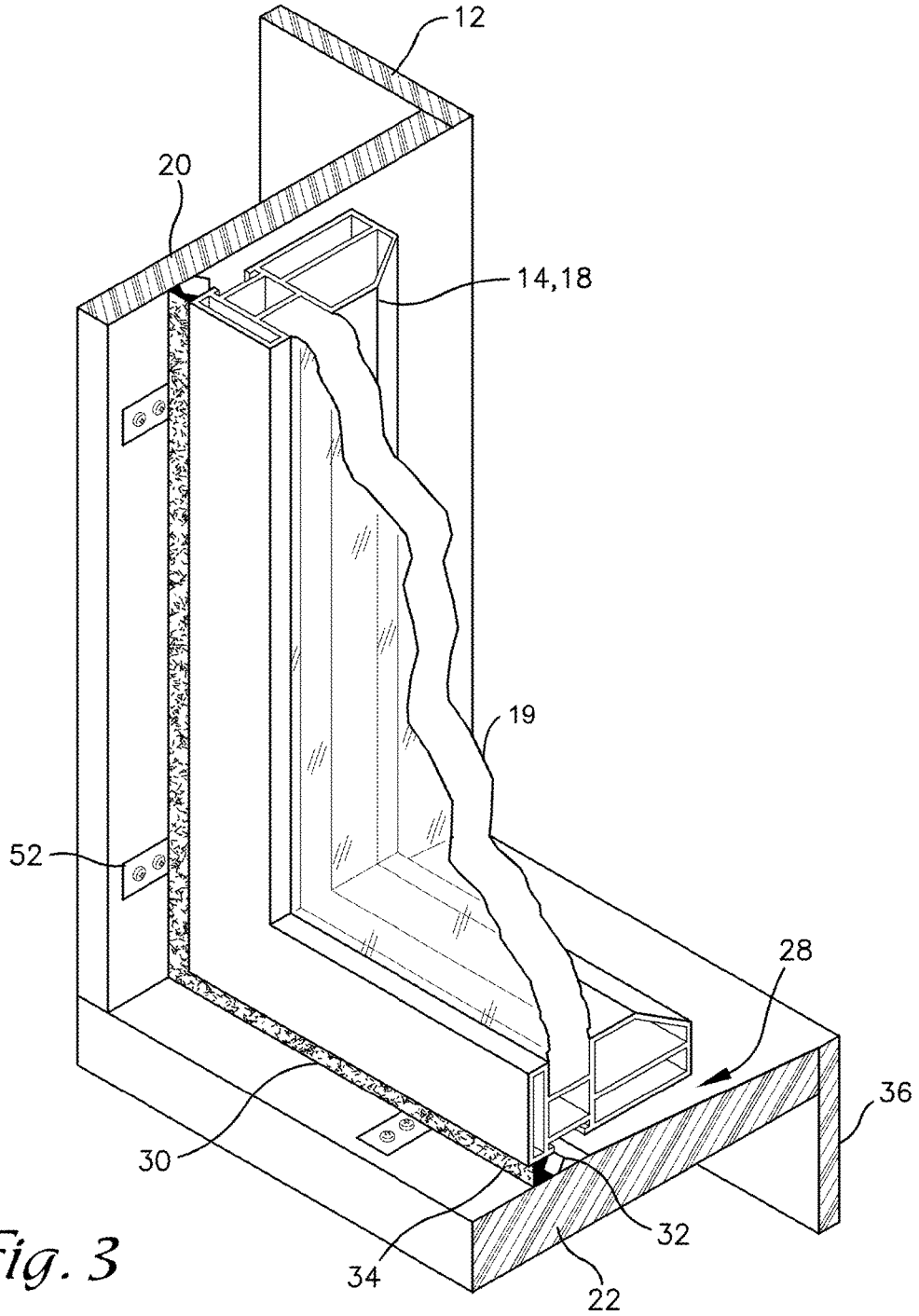
FIG. 3 is an interior partial perspective view of the window liner with the window of FIG. 2 installed therein.

With continued reference to FIGS. 1-7, construction of the window installation 10 is described in accordance with an exemplary embodiment. The window unit 14 is installed in the window liner 12 as depicted in FIG. 2. The window liner 12 can be pre-fabricated and the window unit 14 installed therein, or the window liner 12 can be constructed around the window unit 14. As depicted in FIG. 3, the window unit 14 is secured to the window liner 12 via a plurality of brackets 52 coupled to the window frame 18. Temporary fasteners (not shown) are employed to couple the brackets 52 to the window liner 12; the temporary fasteners are sufficient to couple the window unit 14 to the liner 12 but do not extend through the jambs 20, the header, or the sill 22. The sealing element 30 is installed into the gap 28 between the window liner 12 and the window unit 14 during installation of the window unit 14 into the liner 12.

Installation of the window unit 14 into the window liner 12 can be completed on a workbench in a horizontal orientation. As such, the effects of gravity on the window unit 14 that might hinder or complicate installation in a vertical orientation are not at issue. For example, the window unit 14 is more easily properly aligned with the window liner 12 and the sealing element 30 is not overly compressed or more difficult to install along a bottom edge of the window unit 14 when in the horizontal orientation.

The wall panel 16 is pre-fabricated as described previously above. The wall panel 16 can be moved around a manufacturing facility, to a job site, and/or installed in a structure without the window liner 12 and window unit 14 installed therein. As such, the weight of the wall panel 16 is reduced and such movements can be more easily completed. Additionally, risks of breaking the window unit 14 during such movements are reduced or eliminated. The window liner 12 and window unit 14 can however be temporarily or permanently installed in the respective wall panel 16 before or after transport of the wall panel 16 to the job site.

To install the window liner 12 into the wall panel 16, the window liner 12 is inserted into the opening 48 from an exterior side of the wall panel 16 as depicted in FIG. 4. The jambs 20, the header, and the sill 22 extend into the opening and are dimensioned to extend substantially between an interior face of the framing 40 and an exterior face of the insulating layer 44. The liner 12 can be dimensioned to extend further beyond the interior face of the framing 40, e.g. a distance beyond the interior face of the framing 40 to accommodate a sheathing disposed on the interior face of the framing 40, such as drywall, or the like.

The exterior flange 36 of the window liner 12 is received within the second opening 50 formed by the external sheathing 46. The exterior flange 36 preferably includes a thickness that is substantially equal to the thickness of the external sheathing 46. The exterior flange 36 and the external sheathing 46 thus combine to form a substantially continuous external surface of the wall panel 16 around the window liner 12. A backside of the exterior flange 36 contacts an exposed portion 54 of the insulating layer 44.

When permanent installation of the window liner 12 into the wall panel 16 is desired, an adhesive or similar material is applied to the exposed portion 54 of the insulation layer 44 or to the backside of the exterior flange 36 or both to couple or bond the exterior flange 36 with the insulation layer 44. A sealant 56 is applied over a seam 58 between the exterior flange 36 and the external sheathing 46 to provide a water-tight and/or air-tight seal therebetween. The sealant 56 can comprise a liquid flashing or similar coating or a weather-proof tape or similar material, among others. In one embodiment, the sealant 56 comprises FASTFLASH from Prosoco, of Lawrence, Kans.

The temporary fasteners are replaced with longer, permanent fasteners that extend through the respective jamb 20, header, or the sill 22 and into the framing 40. The window liner 12 may be shimmed, adjusted, or otherwise positioned within the opening 48 to insure proper alignment of the window unit 14 with the overall structure, e.g. to ensure the window unit 14 is level.

The exterior surface of the wall panel 16 can be subsequently finished as desired, e.g. paneling, rock, brick, or the like can be installed thereon. Similarly, the interior surface of the framing 40 can be finished as desired to install drywall or other interior paneling or surface treatments. Trim, brick-mold, or the like can be installed around the window installation 10 to provide desired aesthetics.

Figure 9:
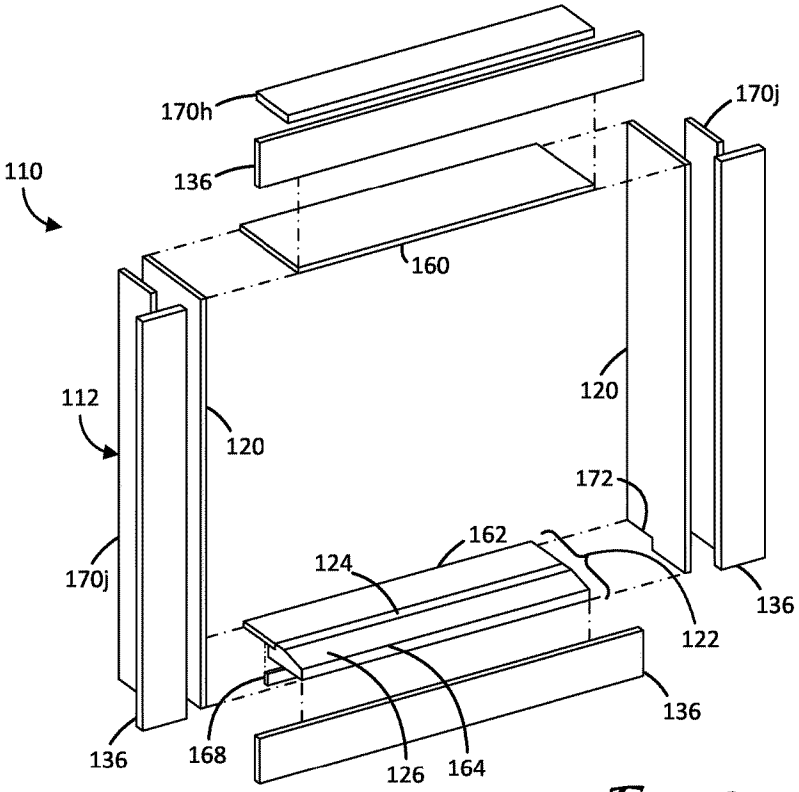
FIG. 9 is an exploded view of the field-fit window liner of FIG. 8.
Figure 8:
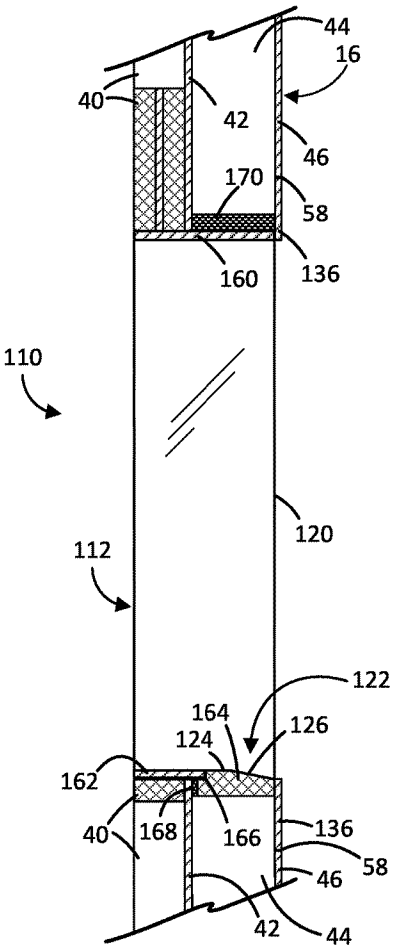
FIG. 8 is a cross-sectional view of a field-fit window liner installed in a wall panel depicted in accordance with another exemplary embodiment.

With reference now to FIGS. 8 and 9, a window liner 112 is described in accordance with an exemplary embodiment. The window liner 112 is configured for installation in the wall panel 16 in the field or at another time after construction of the wall panel 16 is complete. The window liner 112 includes jambs 120, a sill 122, and a header 160 as well as an exterior flange 136. The window liner 112 can be manufactured, the window 14 installed therein, and the window liner 112 installed in the wall panel 16 in a manner similar to that described previously.

The sill 122 of the window liner 112 includes an interior plate 162 and an exterior plate 164. The interior plate 162 is a generally planar section of material that is positioned to extend from an interior side of the window liner 112 toward the exterior and into abutment with the exterior plate 164.

The exterior plate 164 comprises a generally planar component having a thickness substantially greater than that of the interior plate 162 and including a top surface profile that in combination with the interior plate 162 provides the mounting portion 124 (in combination with the interior plate 162) and the sloped portion 126 as described previously above with respect to the sill 22. A rear edge of the exterior plate 164 includes a groove 166 or rabbit joint that is sized to receive a forward edge of the interior plate 162 such that top surfaces of the interior plate 162 and the mounting portion 124 of the exterior plate 164 are generally even or level with one another.

The interior plate 162 is joined with the exterior plate 164 by one or more adhesives, glues or the like disposed on mating faces of the groove 166 and the interior plate 162. The adhesive or glue preferably provides air and/or water tight seal along the interface between the interior and exterior plates 162, 164 and preferably resists transfer of thermal energy between the interior and exterior plates 162, 164. In one embodiment, the adhesive comprises AIRDAM sealant from Prosoco. One or more fasteners, such as construction staples, nails, screws, or the like may also be employed to join the components. The exterior flange 136 is similarly joined with the exterior edge of the exterior plate 164 using one or more adhesives, glues or fasteners and preferably provides an air and/or liquid tight seal therebetween.

A thermal break 168 is disposed along a rear face of the exterior plate 164 to be positioned between the exterior plate 164 and the internal sheathing 42 of the wall panel 112 when the liner 112 is installed therein. The thermal break 168 comprises a thermal insulating material, such as a closed-cell, expanded polystyrene (EPS) foam among other materials. The thermal break 168 may be coupled to the rear edge of the exterior plate 164 or may be disposed in position during installation of the liner 112 in the wall panel 16. A joint between the thermal break 168 and the exterior plate 164 and between the thermal break 168 and the internal sheathing 42 or the wall panel 16 generally is preferably made air-tight such as by applying a suitable quantity of an adhesive, caulking, or similar material like AIRDAM sealant from Prosoco.

An insulating member **170*j* and 170*h* or second thermal break is disposed along outer surfaces of the jambs 120 and on a top surface of the header 160, respectively. In one embodiment, an insulating member may also be provided along a bottom surface of the exterior plate 164. The insulating members 170*j*, 170*h* are positioned to extend between the internal sheathing 42 and an interior surface of the flanges 136 coupled to the jambs 120 and the header 160. The insulating members 170*j*, 170*h* may comprise the same or a different material to that of the thermal break 168 and the insulating layer 44 of the wall panel 16**.

The insulating members **170*j*, 170*h* are coupled to the respective jamb 120 or the header 160 in a manner adapted to provide an air- and/or water tight seal therebetween, such as by applying an adhesive, caulk, tape, flashing, or similar component along the junctions. During installation of the window liner 112 into the wall panel 16 a similar adhesive, caulk, or liquid flashing is applied to one or more surfaces of the insulating members 170*j*, 170*h* and/or to internal sheathing 42 or insulating layer 44 of the wall panel 16 to form an air- and/or water-tight seal therebetween. In one embodiment, AIRDAM sealant from Prosoco is employed. As such, an air- and/or water-tight seal is provided between the window liner 112 and the wall panel 16**.

In one embodiment, to accommodate the insulating member 170 the insulating layer 44 of the wall panel 16 is recessed around the opening 48 a distance to receive the insulating member 170. As such, the framing 40 and the internal sheathing 42 form the opening 48 with first dimensions, the insulating layer 44 forms an opening with second dimensions that are greater than the first dimensions, and the external sheathing 46 forms an opening with third dimensions that are greater than the first and second dimensions. Accordingly, the sill 122, the jambs 120, and the header 160 have outer dimensions configured to fit within the opening 48 having the first dimensions; the insulating member 170 has outer dimensions that are configured for receipt within the second dimensions of the insulating layer 44, and the outer edge of the flange 136 is dimensioned for receipt within the opening in the external sheathing 46 with the third dimensions. In another embodiment, the insulating member 170 is omitted along one or more of the sill 122, the jambs 120 and/or the header 160 and thus the insulating layer 44 of the wall panel 16 is accordingly dimensioned to accommodate the dimensions of the window liner 112.

The insulating member 170, the thermal break 168 and the adhesive employed to join the interior and exterior plates 162, 164 substantially obstruct the flow or conduction of thermal energy between the interior and exterior sides of the sill 122 and/or the window liner 112. In one embodiment, the reduced thickness dimension of the interior plate 162 and thus the reduced contact area between the interior plate 162 and the exterior plate 164 also decrease an amount of thermal transfer that occurs across the sill.

The jambs 120, the header 160, and the flanges 136 are each constructed as described previously above, but for the addition of the insulating member 170 being disposed thereon. The jambs 120 also include a notch 172 that is cut from a lower, rear corner thereof. The notch 172 is sized to receive the framing 40 at the base of the window opening 48.

A sealant or similar material may be applied to faces and seams between components of the window liner 112 to form a water, air and/or thermal-transfer resistant barrier. In one embodiment, the sealant comprises FASTFLASH from Prosoco. The sealant may also comprise a tape or similar fabric material, such as ZIP SYSTEM stretch tape from Huber Engineered Woods, among others.

Figure 11:
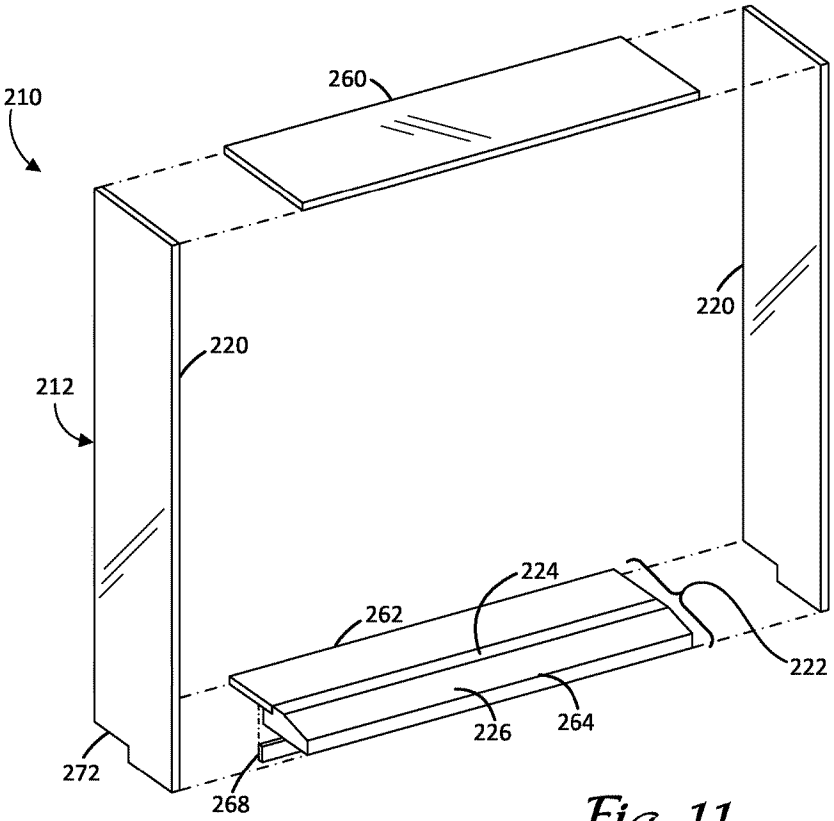
FIG. 11 is an exploded view of the integrated window liner of FIG. 10.
Figure 10:
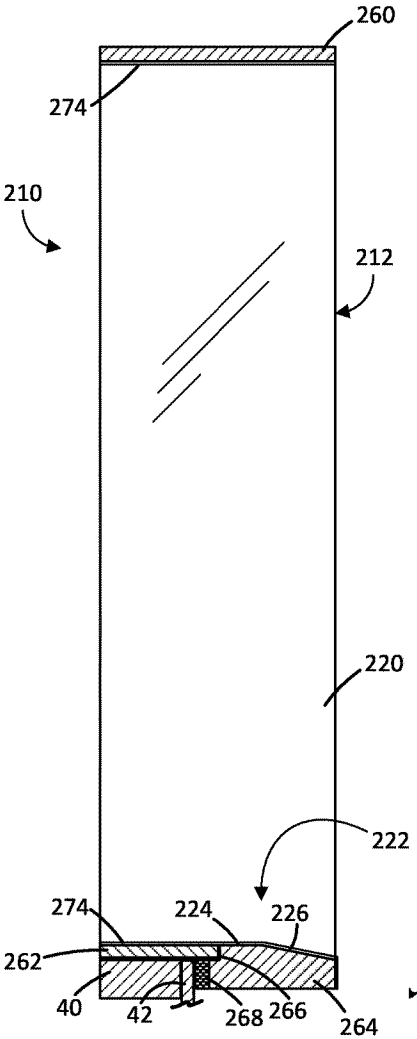
FIG. 10 is a cross-sectional view of an integrated window liner depicted in accordance with another exemplary embodiment.

Referring now to FIGS. 10 and 11, a window liner 212 is described in accordance with an exemplary embodiment. The window liner 212 is configured to be pre-fabricated and integrated into a wall panel 16 during construction of the wall panel 16. The window liner 212 is configured like the window liner 112 but does not include the insulating member 170 or the exterior flanges 136. In one embodiment, the entirety of the surfaces of the window liner 212 that are exposed after integration into the wall panel 16 are coated with a sealant 274, such as FASTFLASH from Prosoco.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A window liner for mounting a window in a wall, the window liner comprising:

a sill comprised of a planar interior plate and an exterior plate that forms a groove configured to receive an edge of the interior plate, the interior plate being coupled to the exterior plate at the groove and being positioned to provide a top surface that is parallel to and even with a top surface of the exterior plate, the top surface of the interior plate and the top surface of the exterior plate of the sill providing a surface profile that includes a planar mounting portion configured to receive a window unit and a sloped portion that extends from the mounting portion to an exterior edge of the sill at a downward slope, an opposite bottom surface of the sill forming a cutout configured to receive at least a frame member of a wall into which the window liner is installed;

a thermal break coupled to the bottom surface of the sill, the thermal break being configured to resist transfer of thermal energy between the sill and the wall;

a pair of jambs having lower ends and upper ends, the lower ends being coupled to the sill;

a header coupled between the upper ends of the jambs; and a water-resistant barrier layer applied to at least one surface of each of the header, the jambs, and the sill.

2. The window liner of claim 1, further comprising the wall, and wherein the sill, the jambs, and the header combine to form an opening in which a window is installable, and wherein the sill, the jambs, and the header each include a flange coupled to an edge thereof and extending outwardly away from the opening on an exterior side of the wall.

3. The window liner of claim 2, wherein the wall includes an exterior sheathing on the exterior side of the wall, and wherein the exterior sheathing is spaced apart from the opening a distance sufficient to receive the flanges of the sill, the jambs, and the header between the opening and the exterior sheathing, the flanges and the exterior sheathing forming a substantially continuous, even surface on the exterior side of the wall.

4. The window liner of claim 1, wherein the lower end of each of the jambs forms a notch configured to receive the frame member of the wall.

5. The window liner of claim 1, wherein the bottom surface of the sill includes an abutment face that is directed toward an interior side of the wall and that forms a portion of the cutout, and wherein the thermal break is coupled to the abutment face.

6. The window liner of claim 1, further comprising:

an insulating member coupled to one or more of the sill, the jambs, and the header, wherein the sill, the jambs, and the header combine to form an opening in which a window is installable, and the insulating member being disposed on a surface of the respective sill, jamb, or header that is opposite from the opening.

7. A window liner for mounting a window in a wall, the window liner comprising:

a sill having a top surface profile that includes a planar mounting portion configured to receive a window unit and a sloped portion that extends from the mounting portion to an exterior edge of the sill at a downward slope, an opposite bottom surface of the sill forming a cutout configured to receive at least a frame member of a wall into which the window liner is installed;

a thermal break coupled to the bottom surface of the sill along a surface of the cutout, the thermal break being configured to resist transfer of thermal energy between the sill and the wall;

a pair of jambs having lower ends and upper ends, the lower ends being coupled to the sill;

a header coupled between the upper ends of the jambs, the header, the jambs, and the sill forming an opening in which a window is installable;

a flange coupled to an exterior edge of each of the sill, the jambs, and the header and extending outwardly from the opening; and a wall including framing that defines a window fenestration having first dimensions, an internal sheathing coupled to an exterior side of the framing, a rigid insulation disposed on the internal sheathing, and an exterior sheathing coupled to the wall to capture the rigid insulation between the exterior sheathing and the internal sheathing, the internal sheathing and the insulation being formed to provide the window fenestration with the first dimensions, the exterior sheathing being formed to provide an aperture with second dimensions that are greater than the first dimensions and that is aligned with the window fenestration, wherein the window liner is disposed in the window fenestration and the flange is received in the aperture in the exterior sheathing.

8. The window liner of claim 7, wherein the flange has a thickness substantially equal to a thickness of the exterior sheathing and forms a substantially continuous surface with the exterior sheathing.

9. The window liner of claim 7, further comprising:

an insulating member disposed on a side of one or more of the sill, the jambs, and the header that is opposite from the opening.

10. The window liner of claim 9, wherein the rigid insulation is formed around the window fenestration to provide a second aperture with third dimensions that are larger than the first dimensions but smaller than the second dimensions, and wherein the third dimensions a suitable to receive the insulating member on the sill, the jambs, and the header.

11. The window liner of claim 7, wherein the window liner is configured for installation in a premanufactured wall panel at a construction site.

12. The window liner of claim 7, wherein the sill is comprised of an interior plate and an exterior plate, the interior plate being substantially planar and having a thickness substantially less than the exterior plate, the interior plate being coupled to the exterior plate by one or more adhesives, the one or more adhesives being adapted to resist transfer of thermal energy.

13. A method for installing a window liner in a wall comprising:

providing a wall including framing that defines a window fenestration having first dimensions, an internal sheathing coupled to an exterior side of the framing, a rigid insulation disposed on the internal sheathing, and an exterior sheathing coupled to the wall to capture the rigid insulation between the exterior sheathing and the internal sheathing, the internal sheathing and the insulation being formed to provide the window fenestration with the first dimensions, the exterior sheathing being formed to provide an aperture that is aligned with the window fenestration and that includes second dimensions that are greater than the first dimensions;

constructing a window liner including a pair of jambs having a sill coupled between lower ends and a header coupled between upper ends thereof to form an opening, and including a flange coupled to an exterior edge of the jambs, the sill, and the header and extending outwardly away from the opening of the window liner and the sill having a top surface profile that includes a planar mounting portion configured to receive a window unit and a sloped portion that extends from the mounting portion to an exterior edge of the sill at a downward slope;

installing a window unit in the window liner;

inserting, from an exterior side of the wall, the jambs, the sill, and the header of the window liner into the window fenestration, the sill including an opposite bottom surface forming a cutout configured to receive at least a frame member of the wall forming the window fenestration, the sill further including a thermal break coupled to the bottom surface of the sill along a surface of the cutout, the thermal break being configured to resist transfer of thermal energy between the sill and the wall; and inserting the flange of the window liner into the aperture formed by the exterior sheathing, the flange and the exterior sheathing forming a substantially continuous, even exterior surface.

14. The method of claim 13, wherein the sill includes an interior plate and an exterior plate, the interior plate being substantially planar and having a thickness substantially less than the exterior plate, the interior plate being coupled to the exterior plate by one or more adhesives, the one or more adhesives being adapted to resist transfer of thermal energy.

15. The method of claim 14, further comprising:

installing the thermal break on the bottom surface of the sill, the thermal break being positioned to lie between the exterior plate and the internal sheathing of the wall.

16. The method of claim 13, further comprising:

installing an insulating member on an outer surface of each of the jambs, and on a top surface of the header, the insulating member being positioned to extend between the respective flange and the internal sheathing of the wall.

17. The method of claim 16, further comprising:

forming the rigid insulation of the wall around the window fenestration to provide a second aperture having third dimensions that are greater than the first dimensions but less than the second dimensions;

applying a sealant on a contact surface between the window liner and the wall; and disposing the insulating members coupled to the window liner into the second aperture having the third dimensions formed by the rigid insulation, the sealant forming an air-tight seal between the insulating members and the wall.

18. The method of claim 13, wherein the wall comprises a premanufactured wall panel and further comprising:

transporting the wall panel with the window liner installed therein to a construction site;

removing the window liner from the wall panel to reduce the weight of the wall panel and to reduce a risk of breaking the window unit;

installing the wall panel in a building;

reinstalling the window liner in the wall panel.

* * * * *